US008747139B2

(12) United States Patent
Amano

(10) Patent No.: US 8,747,139 B2
(45) Date of Patent: Jun. 10, 2014

(54) AUXILIARY FITTING HAVING A LAMINATE TERMINAL FITTING WITH AN ASSEMBLING PORTION HAVING INTERLOCKING PORTIONS

(75) Inventor: Takamaru Amano, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/424,897

(22) Filed: Mar. 20, 2012

(65) Prior Publication Data

US 2012/0252249 A1 Oct. 4, 2012

(30) Foreign Application Priority Data

Mar. 29, 2011 (JP) ..... 2011-073021

(51) Int. Cl.
*H01R 13/28* (2006.01)

(52) U.S. Cl.
USPC ..... 439/287

(58) Field of Classification Search
USPC ..... 439/284–287, 352
See application file for complete search history.

(56) References Cited

U.S. PATENT DOCUMENTS

| | | | | |
|---|---|---|---|---|
| 3,316,522 | A | 4/1967 | Demler | |
| 4,968,268 | A * | 11/1990 | Oh | 439/411 |
| 5,934,923 | A * | 8/1999 | Matsuoka et al. | 439/287 |
| 6,086,399 | A * | 7/2000 | Matsunaga et al. | 439/287 |
| 6,530,795 | B2 * | 3/2003 | Maeda et al. | 439/287 |
| 7,867,044 | B2 * | 1/2011 | Lee | 439/883 |
| 2002/0132507 | A1 * | 9/2002 | Maeda et al. | 439/284 |

FOREIGN PATENT DOCUMENTS

FR 2945156 11/2010

* cited by examiner

*Primary Examiner* — Chandrika Prasad
(74) *Attorney, Agent, or Firm* — Gerald E. Hespos; Michael J. Porco; Matthew T. Hespos

(57) ABSTRACT

An auxiliary fitting (10) is used in using a laminate terminal fitting (30) including interlocking portions (37) to be engaged with another terminal fitting placed on one surface side at a peripheral edge of an insertion hole (36), through which a fastening device (B) is insertable, without being assembled with the other terminal fitting. The interlocking portions (37) are so formed that plate surfaces are shifted toward the one surface side relative to other parts (48) and interlocking portions of the other terminal fitting are to be inserted into and engaged with recesses (38) formed at the other surface side of the interlocking portions (37). The auxiliary fitting (10) includes auxiliary inserting portions (12) to be inserted into the recesses (38) of the interlocking portions (37) and placed in contact with the interlocking portions (37).

7 Claims, 10 Drawing Sheets

AUXILIARY FITTING HAVING A LAMINATE TERMINAL FITTING WITH AN ASSEMBLING PORTION HAVING INTERLOCKING PORTIONS

BACKGROUND OF THE INVENTION

1. Field of the Invention

The invention relates to an auxiliary fitting used in or for individually using a laminate terminal fitting.

2. Description of the Related Art

U.S. Pat. No. 5,934,923 discloses laminate terminal fittings that are assembled by placing a plurality of terminal fittings one over another. The assembled laminate terminal fittings then are fixed collectively to a body by a fastening device, such as a bolt. More particularly, each terminal fitting is formed with an insertion hole through which a common fastening device is insertable, and interlocking portions are provided at a peripheral edge of each insertion hole for interlocking the terminal fittings that have been placed one over the other. Specifically, the interlocking portions of the terminal fitting arranged below are formed so that the plate surfaces thereof are shifted toward an upper side relative to the other parts, thereby forming recesses below. The interlocking portions of the terminal fitting arranged above are formed so that the plate surfaces thereof are shifted toward a lower side relative to the other parts and are inserted below the interlocking portions of the lower terminal fitting. In this way, two terminal fittings are assembled one over the other. The entire peripheries of the insertion holes are pressed against each other and held in contact when the fastening device is inserted into the insertion holes and fastened.

The above-described laminate terminal fitting is premised on the use of at least one pair of terminal fittings assembled with each other. However, in some cases these terminal fittings are used separately. In such a case, the interlocking portions are lifted since one of the interlocking portions that are supposed to be arranged one over the other is not present. Therefore there has been a problem that the terminal fitting may be deformed by a fastening force of the fastening device and, consequently may be broken.

The present invention was completed in view of the above situation and an object thereof is to improve operability of an auxiliary fitting.

SUMMARY OF THE INVENTION

The invention relates to an auxiliary fitting for use with a laminate terminal fitting. The laminate terminal fitting has opposite first and second surfaces and an insertion hole through which a fastening device is insertable. At least one interlocking portion is formed at a periphery of the insertion hole and can be engaged with another laminate terminal fitting. The interlocking portion is formed so that the surfaces of the laminate terminal fitting are shifted at the interlocking portion relative to other parts of the laminate terminal fitting. At least one interlocking portion of another terminal fitting can be inserted into and engaged with at least one recess formed at the second surface of the interlocking portion. The auxiliary fitting has at least one auxiliary inserting portion to be inserted into the recess of the interlocking portion and placed in contact with the interlocking portion when the laminate terminal is not to be assembled with another terminal fitting.

The auxiliary fitting may further have at least one auxiliary placing portion on the first surface at the periphery of the insertion hole and near the interlocking portion.

The interlocking portion is supported on the auxiliary inserting portion. Thus, the interlocking portion will not be deformed by a fastening force of the fastening device and the laminate terminal fitting can be used individually.

The auxiliary fitting may comprise an auxiliary insertion hole through which the fastening device is insertable.

The auxiliary inserting portion and/or the auxiliary placing portion may be provided at a periphery of the auxiliary insertion hole.

The auxiliary fitting is assembled with the terminal fitting and the assembly is fixed to a body by the fastening device. Thus, the auxiliary fitting cannot shift relative to the terminal fitting.

The auxiliary fitting may further comprise a main body formed with the auxiliary inserting portion and/or the auxiliary placing portion.

The auxiliary fitting may further comprise a projection projecting out from the main body. The projection can be held when assembling the auxiliary fitting with the terminal fitting. Thus, an assembling operation can be performed easily.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A first embodiment of the invention is described with reference to FIGS. 1 to 7. An auxiliary fitting 10 according to this embodiment is used with a laminate terminal fitting 30. The laminate terminal fitting 30 can be assembled with one or more other laminate terminal fittings on its upper and/or lower sides. However, the auxiliary terminal fitting 10 enables the laminate terminal fitting 30 to be used without being assembling with other laminate terminal fittings (not shown). This laminate terminal fitting 30 is a ground terminal fitting that typically would be assembled with other such fittings and mounted on a vehicle body or the like (not shown).

Figure 3:
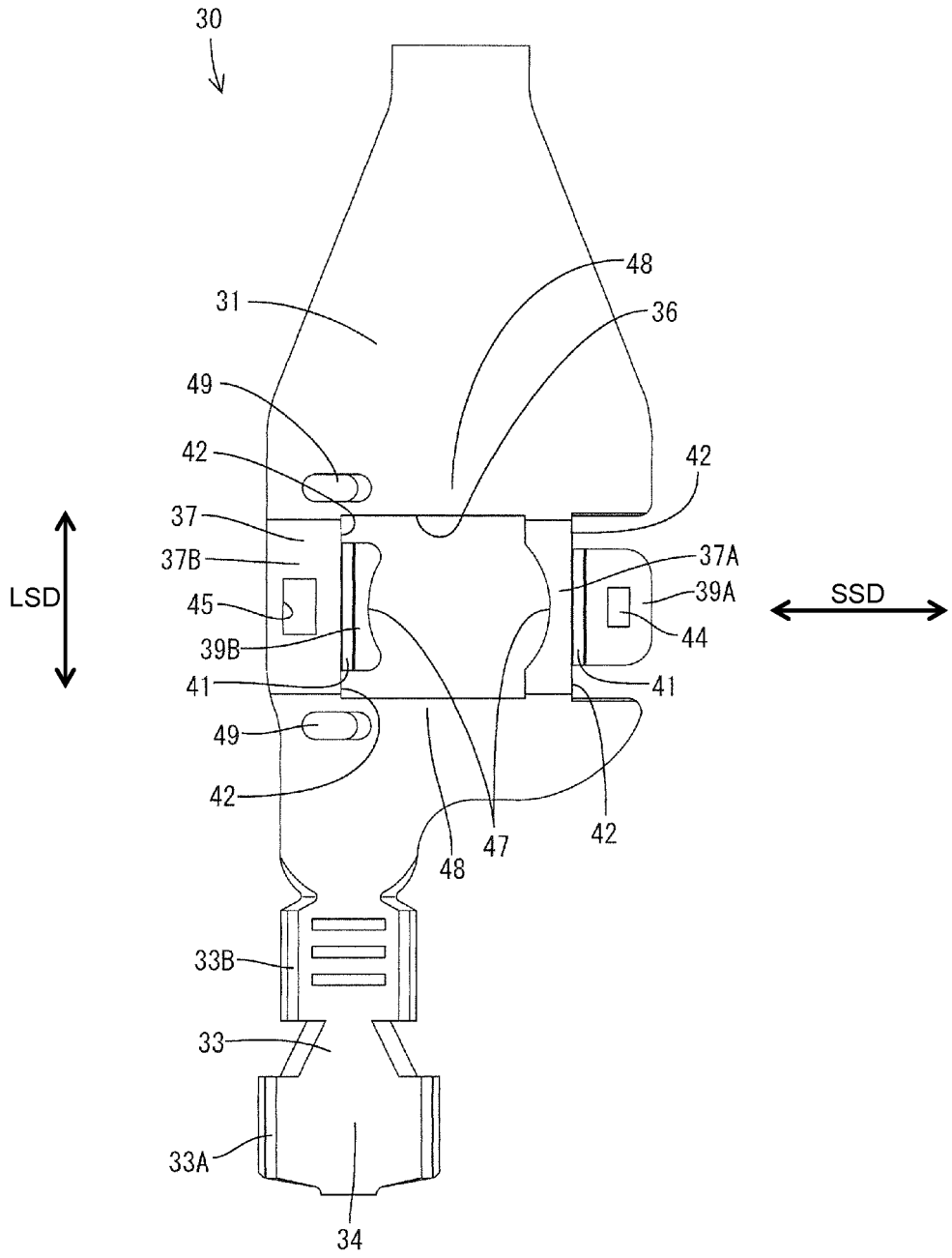
FIG. 3 is a plan view of a terminal fitting.

The terminal fitting 30 is formed by bending, folding and/or embossing an electrically conductive metal plate material punched or cut into a specified shape, and includes an assembling portion 31 to be assembled with another terminal fitting and a wire connecting portion 33 to be connected to a wire 32, as shown in FIG. 3.

The wire connecting portion 33 is unitary with one longitudinal end of the assembling portion 31 and extends along the long-side direction LSD of the assembling portion 31 from a corner on one end of the assembling portion 31 in a short-side direction SSD that is substantially normal to the long-side direction LSD. The wire connecting portion 33 includes an insulation barrel 33A and a wire barrel 33B. The insulation barrel 33A is to be crimped, bent or folded to connect to an insulation coating 32A at an end of a ground wire 32 extending from a device. The wire barrel 33B is to be crimped, bent or folded to connect to a core 32B exposed by removing the insulation coating 32A of the wire 32 (see FIG. 5). Crimping pieces project at opposite sides of a bottom plate 34 at each of the insulation barrel 33A and the wire barrel 33B. The bottom plate 34 is substantially flat and extends from the assembling portion 31. The assembling portion 31 is formed with an insertion hole 36 through which a bolt B is insertable.

This terminal fitting 30 and another terminal fitting with substantially identically shaped assembling portions 31 can be assembled by holding the surfaces of the assembling portions 31 substantially opposite to each other, placing these surfaces one over the other so that the leading ends of interlocking portions 37 face each other and sliding the assembling portions 31 along an assembling direction that extends in the short-side direction SSD.

Figure 4:
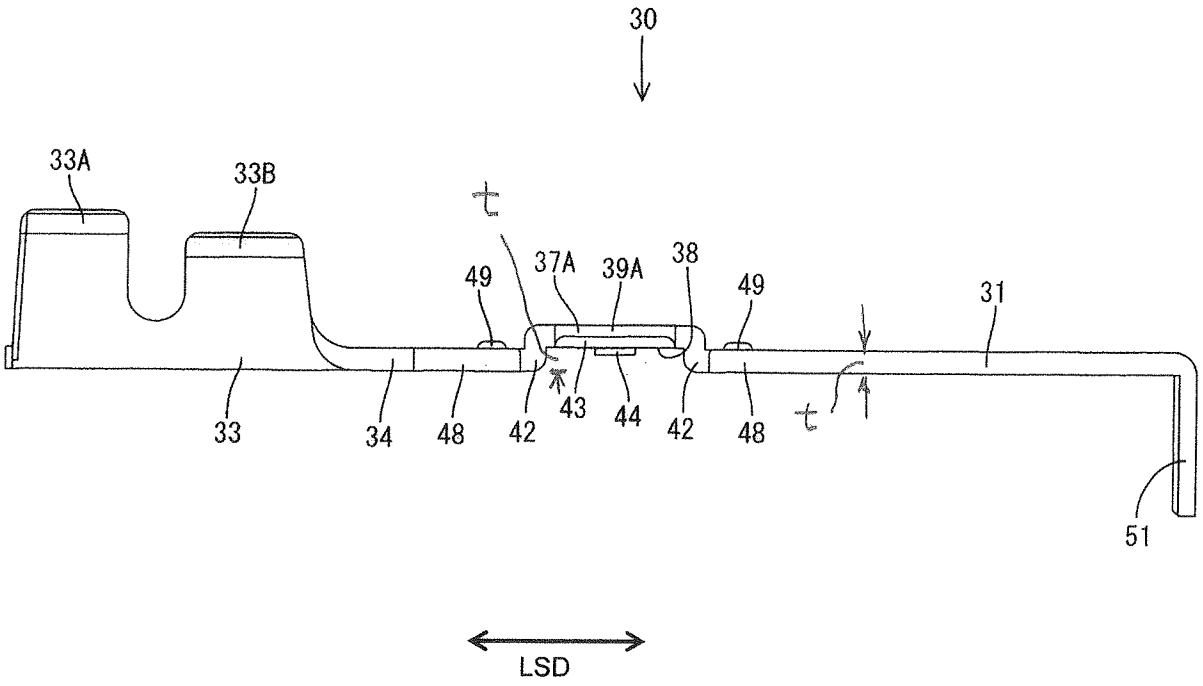
FIG. 4 is a side view of the terminal fitting.
Figure 5:
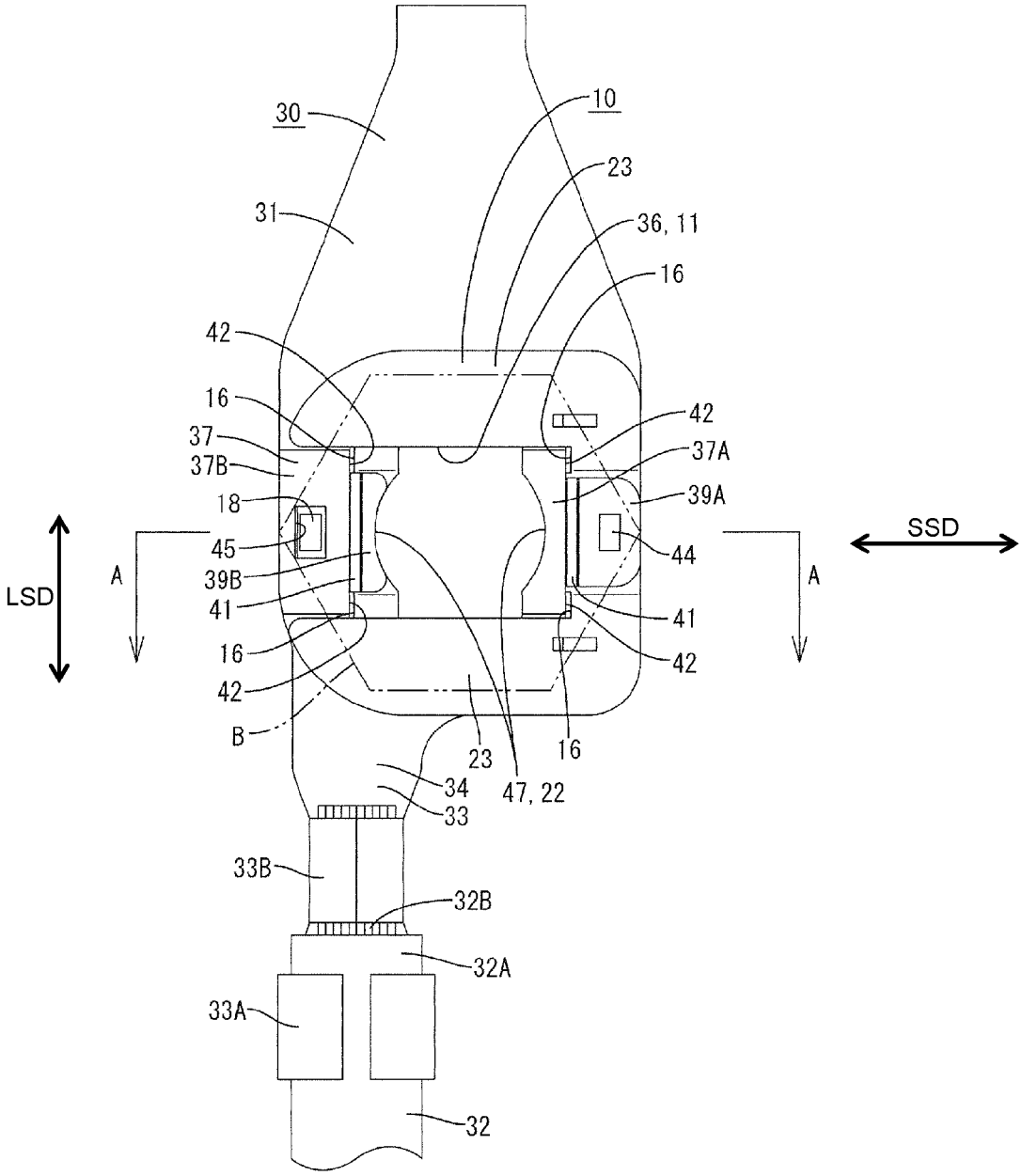
FIG. 5 is a plan view showing the terminal fitting in an assembled state with the auxiliary fitting.
Figure 6:
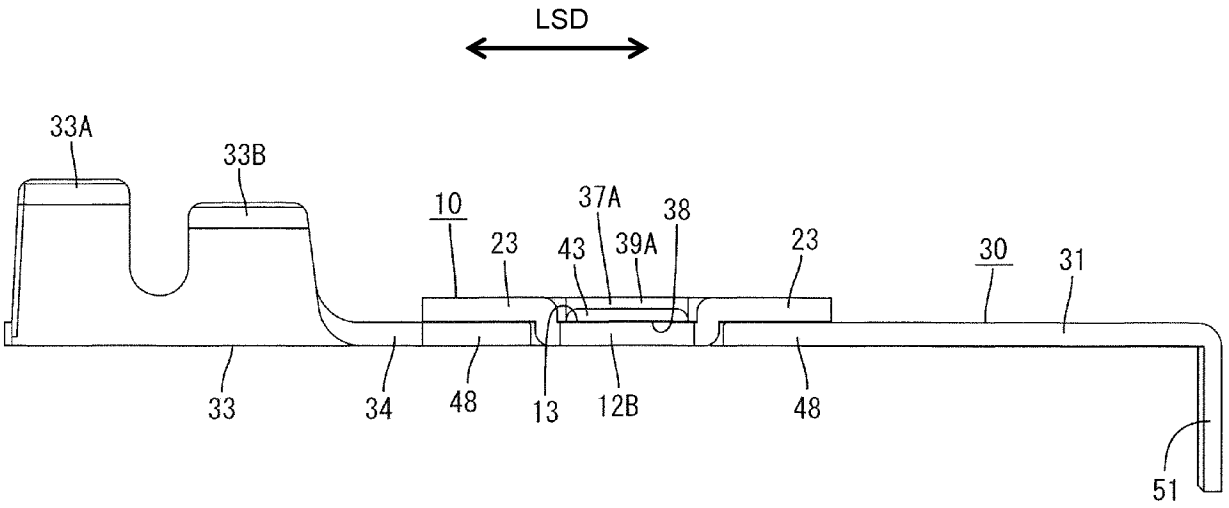
FIG. 6 is a side view showing the terminal fitting in the assembled state with the auxiliary fitting.

The interlocking portions 37 to be engaged with another terminal fitting placed on the upper surface are provided on two sides of the peripheral edge of the insertion hole 36 and substantially face each other in the assembling direction. As shown in FIG. 4, the plate surfaces of the interlocking portions 37 are shifted up relative to the other parts substantially by the thickness t of the plate material to define steps at opposite ends of the interlocking portions 37, as shown in FIG. 4. Thus, the interlocking portions of another terminal fitting can be inserted into and engaged in recesses 38 formed at the lower surface. The two interlocking portions 37 are at substantially the same height. Further, concentric arcuate portions 47 are provided on edges of the interlocking portions 37 closer to the insertion hole 36 and have the same diameter (see FIG. 3). The interlocking portion 37 at the front in the assembling direction is referred to as a front interlocking portion 37A and the interlocking portion 37 at the rear is referred to as a rear interlocking portion 37B.

Extending pieces 39A, 39B are cantilevered forward in the assembling direction from the respective interlocking portions 37A, 37B (see FIG. 3) and are flush with the interlocking portions 37A, 37B. The extending piece 39A of the front interlocking portion 37A extends out away from the insertion hole 36 and the extending piece 39B of the rear interlocking portion 37B extends in toward the insertion hole 36. The extending piece 39A of the front interlocking portion 37A is longer and narrower than the extending piece 39B of the rear interlocking portion 37B. The extending piece 39A of the front interlocking portion 37A extends toward the outer edge of the assembling portion 31, but does not extend beyond the outer edge of the assembling portion 31. An inclined guide surface 43 is formed on the lower surface of the leading end edge of the extending piece 39A of the front interlocking portion 37A to facilitate assembly with the other terminal fitting (see FIG. 7).

A groove 41 is formed in the upper surface of each extending piece 39A, 39B and extends straight over the entire width at the base end of each extending piece 39A, 39B.

Slits 42 are provided at opposite ends of the extending pieces 39A, 39B and can receive parts of another terminal fitting.

Figure 7:
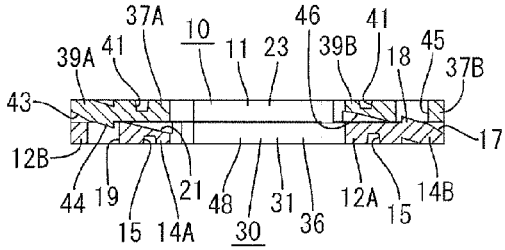
FIG. 7 is a section along A-A of FIG. 5 showing the terminal fitting in the assembled state with the auxiliary fitting.

A locking claw 44 is provided at a substantially central position on the front interlocking portion 37A and is formed by hammering or shaping the extending piece 39A of the front interlocking portion 37A, as shown in FIGS. 3 and 7. A locking hole 45 penetrates the rear interlocking portion 37B at a widthwise central position and has a substantially rectangular shape so that the locking claw of the other terminal fitting can fit therein. An inclined guide 46 is provided before the locking hole 45 in the assembling direction and extends from the leading end edge of the extending piece 39B of the rear interlocking portion 37B to the vicinity of the locking hole 45 (see FIG. 7).

Placing portions 48 are provided on parts of the periphery of the insertion hole 36 except the interlocking portions 37 and another terminal fitting can be placed thereon (see FIG. 7). A projection 49 is hammered to project up on each placing portion 48 (see FIG. 4) and is long in the assembling direction (see FIG. 3). The projections 49 are provided at the opposite sides of the rear interlocking portion 37B.

A rotation preventing portion 51 is provided at an end of the assembling portion 31 opposite to the wire connecting portion 33 (see FIG. 4). The rotation preventing portion 51 is bent down at a substantially right angle to the assembling portion 31, and can be inserted into an unillustrated locking groove formed in a body or the like for preventing rotation of the terminal fitting 30 during bolt fastening.

The auxiliary fitting 10 is formed from an electrically conductive metal plate material with substantially the same thickness as the terminal fitting 30 and punching, cutting and/or bending the plate into a specified shape. The auxiliary fitting 10 has substantially the same structure as a part of the assembling portion 31 of the terminal fitting 30 around the insertion hole 36, including having the thickness t. This auxiliary fitting 10 is placed on the assembling portion 31 so that the lower surface of the auxiliary fitting 10 faces the upper surface of the assembling portion 31 of the terminal fitting 30 and the leading ends of auxiliary inserting portions 12 face the leading ends of the interlocking portions 37 of the terminal fitting 30. The terminal fitting 30 and the auxiliary fitting 10 are slid into assembly along a facing direction of the auxiliary inserting portions 12 and the interlocking portions 37 (see FIG. 5). Note that the sliding direction of the auxiliary fitting 10 and the terminal fitting 30 is the same as the assembling direction of the terminal fitting 30 and the other terminal fitting and also is referred to herein as the assembling direction.

Figure 1:
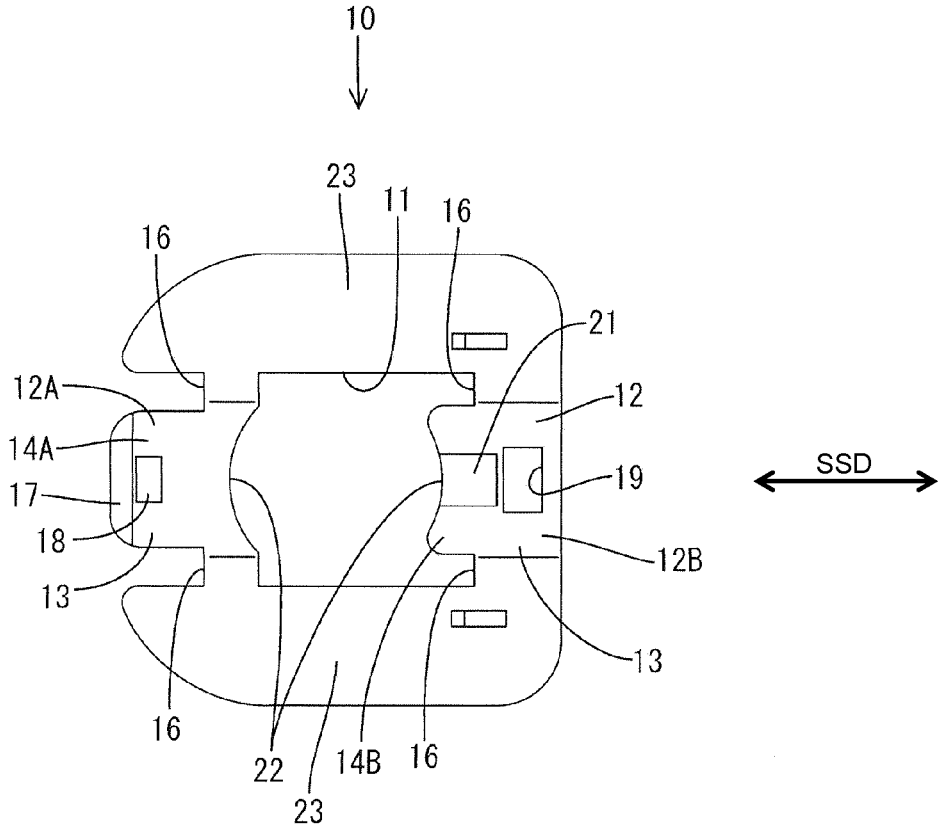
FIG. 1 is a plan view of an auxiliary fitting according to a first embodiment.
Figure 2:
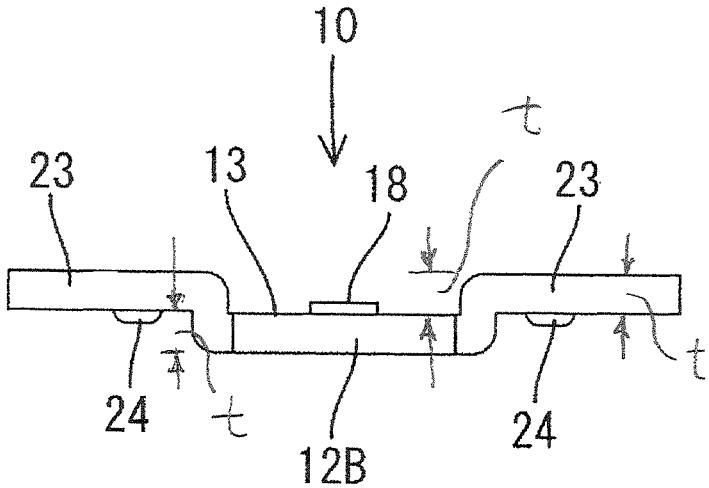
FIG. 2 is a side view of the auxiliary fitting.

As shown in FIG. 1, the auxiliary fitting 10 is substantially rectangular and an auxiliary insertion hole 11 is provided at a substantially central position for receiving the bolt B. The auxiliary insertion hole 11 has substantially the same size and shape as the insertion hole 36 of the terminal fitting 30.

Two auxiliary inserting portions 12 are provided at peripheral sides of the auxiliary insertion hole 11 that face in the assembling direction. The auxiliary inserting portions 12 are shifted down from the other parts by the thickness t of the plate material so that steps to other parts are defined at opposite ends of the auxiliary inserting portions 12. Thus, the interlocking portions 37 of the terminal fittings 30 can fit into auxiliary recesses 13 formed at the upper sides of the auxiliary inserting portions 12 (see FIG. 6). The thickness t of the auxiliary inserting portions 12 substantially equals the depth of the recesses 38 of the terminal fitting 30, as shown in FIG.

4. The two auxiliary inserting portions 12 are at substantially the same height in a thickness direction. Concentric arcuate portions 22 are provided on edges of the of auxiliary inserting portions 12 closer to the auxiliary insertion hole 11 and have substantially the same diameter (see FIG. 1). Note that, the auxiliary inserting portion 12 at the front side in the assembling direction is referred to as a front inserting portion 12A and the auxiliary inserting portion 12 at the rear side is referred to as a rear inserting portion 12B.

The extending pieces 14A, 14B are cantilevered forward in the assembling direction from the respective front and rear auxiliary inserting portions 12A and 12B and are flush with the auxiliary inserting portions 12A and 12B. The extending piece 14A of the front inserting portion 12A extends out from the auxiliary insertion hole 11 and the extending piece 14B of the rear inserting portion 12B extends in toward the auxiliary insertion hole 11. The extending piece 14A of the front inserting portion 12A is longer and narrower than the extending piece 14B of the rear inserting portion 12B. The leading end edge of extending piece 14A of the front inserting portion 12A extends substantially along the outer edge of the auxiliary fitting 10, but does not project out from the outer edge of the auxiliary fitting 10. An inclined auxiliary guide surface 17 is formed on the upper side of the leading end edge of the extending piece 14A of the front inserting portion 12A to facilitate assembly with the terminal fitting 30 (see FIG. 1).

A groove 15 is formed in the lower surface of each extending piece 14A, 14B and extends straight in the width direction near the base end of each extending piece 14A, 14B (see FIG. 7). Slits 16 are provided at the opposite sides of each extending piece 14A, 14B and can receive parts coupling the interlocking portions 37 and the placing portions 48 of the terminal fitting 30.

An auxiliary locking claw 18 is formed on the front inserting portions 12A by hammering or shaping the extending piece 14A of the front inserting portions 12A at a substantially central position. An auxiliary locking hole 19 is provided at a central position of the rear inserting portion 12B and has a substantially rectangular shape for receiving the locking claw 44. An inclined auxiliary guide 21 is provided before the auxiliary locking hole 19 in the assembling direction and extends from the leading end edge of the extending piece 14B of the rear inserting portion 12B to the vicinity of the auxiliary locking hole 19 for guiding the locking claw 44 of the terminal fitting 30 (see FIGS. 1 and 7).

The auxiliary placing portions 23 are defined at parts of the peripheries of the auxiliary insertion hole 11 except the auxiliary inserting portions 12 and can be placed on the placing portions 48 of the terminal fitting 30. The auxiliary placing portions 23 are to be arranged on the upper side of the assembling portion 31 of the terminal fitting 30 near the interlocking portions 37 of the terminal fitting 30 (see FIG. 5). The auxiliary placing portions 23 are dimensioned to cover substantially the entire periphery of the insertion hole 36 of the terminal fitting 30 except the interlocking portions 37 (i.e. the entire placing portions 48). Ends of the auxiliary placing portions 23 on opposite sides of the front inserting portion 12A are tapered to reduce the width toward the front in the assembling direction. The auxiliary fitting 10 is symmetrical with respect to a line passing through a center between the pair of auxiliary inserting portions 12.

An auxiliary projection 24 is formed on each auxiliary placing portion 23 (e.g. by hammering) so that the auxiliary projections 24 are at opposite sides of the rear inserting portion 12B. Both auxiliary projections 24 are long in the assembling direction and project down.

The auxiliary fitting 10 is assembled with the terminal fitting 30 so that the auxiliary inserting portions 12 of the auxiliary fitting 10 are placed on the interlocking portions 37 of the terminal fitting 30 and the auxiliary placing portions 23 of the auxiliary fitting 10 are placed on the placing portions 48 of the terminal fitting 30. Thus, the terminal fitting 30 and the auxiliary fitting 10 are assembled at the peripheral edge of the insertion hole 36 with the lower side of the auxiliary fitting 10 placed on the upper side of the terminal fitting 30. At this time, the upper surfaces of the auxiliary placing portions 23 and those of the interlocking portions 37 are at substantially the same height and substantially coplanar in a first plane, while the lower surfaces of the auxiliary inserting portions 12 and those of the placing portions 48 are at the same height and substantially coplanar in a second plane (see FIG. 6).

The auxiliary fitting 10 is placed on the upper side of the terminal fitting 30 so that the auxiliary inserting portions 12 of the terminal fitting 10 face the interlocking portions 37 of the terminal fitting 30. The auxiliary fitting 10 and the terminal fitting 30 then are slid in the facing direction. Parts of the auxiliary fitting 10 that couple the auxiliary inserting portions 12 and the auxiliary placing portions 23 and parts of the terminal fitting 30 that couple the interlocking portions 37 and the placing portions 48 are inserted to the back ends of the mating slits 16, 42. Additionally, the auxiliary inserting portions 12 fit into the recesses 38 at the lower sides of the interlocking portions 37 and the interlocking portions 37 fit into the auxiliary recesses 13 at the upper sides of the auxiliary inserting portions 12. As a result, the centers of the auxiliary insertion hole 11 and the insertion hole 36 coincide, the auxiliary locking claw 18 of the auxiliary fitting 10 engages the locking hole 45 of the terminal fitting 30 and the locking claw 44 of the terminal fitting 30 engages the auxiliary locking hole 19 of the auxiliary fitting 10 (see FIG. 7). In this way, the assembling of the terminal fitting 30 and the auxiliary fitting 10 is completed.

The bolt B then is inserted into the insertion hole 36 of the terminal fitting 30 assembled with the auxiliary fitting 10 and is fastened to the body. The bolt B contacts the upper surfaces of the interlocking portions 37 of the terminal fitting 30 and upper surfaces of the auxiliary placing portions 23 of the auxiliary fitting 10 and applies a fastening force on the entirety of these surfaces. The fastening force presses the interlocking portions 37 against the auxiliary inserting portions 12 of the auxiliary fitting 10 at the lower sides, and presses the auxiliary placing portions 23 against the placing portions 48 of the terminal fitting 30 at the lower sides. In this way, the auxiliary fitting 10 and the terminal fitting 30 are held strongly in contact over substantially the entire circumference of the insertion hole 36, and the terminal fitting 30 is pressed against and fixed to the body.

The auxiliary fitting 10 of this embodiment is used when the laminate terminal fitting 30 is used without another terminal fitting assemble thereon. The interlocking portions 37 are formed so that the plate surfaces thereof are shifted up relative to the other parts, the recesses 38 are formed at the lower sides of the interlocking portions 37 and the interlocking portions of the other terminal fitting are to be inserted into the recesses 38. The auxiliary fitting 10 includes the auxiliary inserting portions 12 to be inserted into the recesses 38 of the interlocking portions 37 and placed below the interlocking portions 37.

In this way, the interlocking portions 37 are supported on the auxiliary inserting portions 12 so that the interlocking portions 37 are not by the fastening force of the bolt B. The bolt B, the interlocking portions 37 and the auxiliary inserting portions 12 are fixed to the body while being held in close contact. Thus, the interlocking portions 37 cannot be lifted from the body to reduce a contact area with the body. As described, the auxiliary fitting 10 of this embodiment eliminates the problem of using the laminate terminal fitting 30 individually. Therefore, it is not necessary to produce a separate terminal fitting, which leads to a cost reduction.

The auxiliary placing portions 23 of the auxiliary fitting 10 are arranged on top of the placing portions 48 at the periphery of the insertion hole 36 and near the interlocking portions 37. Accordingly, the auxiliary placing portions 23 receive the fastening force of the bolt B near the interlocking portions 37 so that the interlocking portions 37 do not deform. As a result, the problems of using the laminate terminal fitting 30 individually are eliminated more reliably.

Further, the auxiliary fitting 10 includes the auxiliary insertion hole 11 for receiving the bolt B and the auxiliary inserting portions 12 and the auxiliary placing portions 23 are provided at the periphery of the auxiliary insertion hole 11. Thus, the bolt fixes the assembly of the auxiliary fitting 10 and the terminal fitting 30 to the body and prevents a position shift of the auxiliary fitting 10 relative to the terminal fitting 30.

Figure 8:
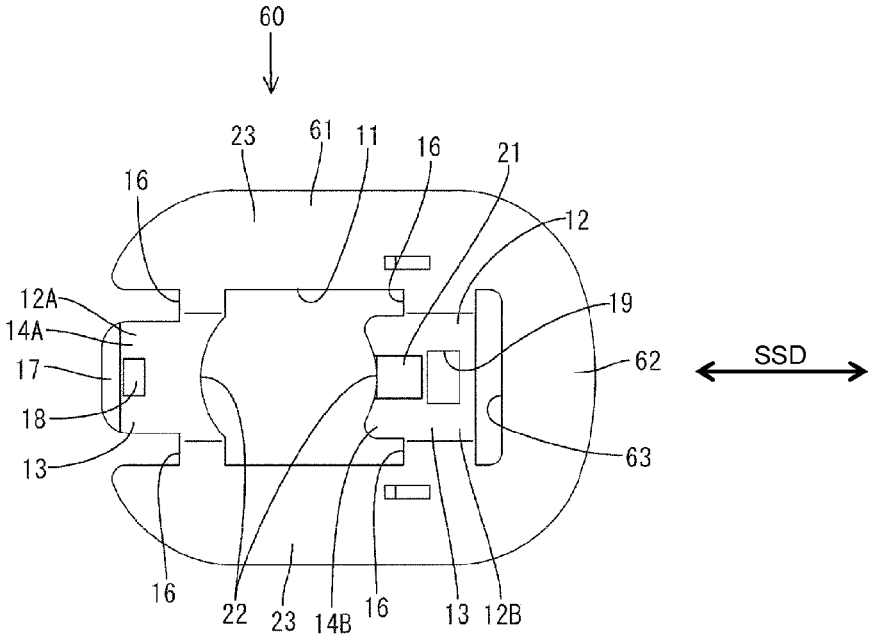
FIG. 8 is a plan view of an auxiliary fitting according to a second embodiment.
Figure 9:
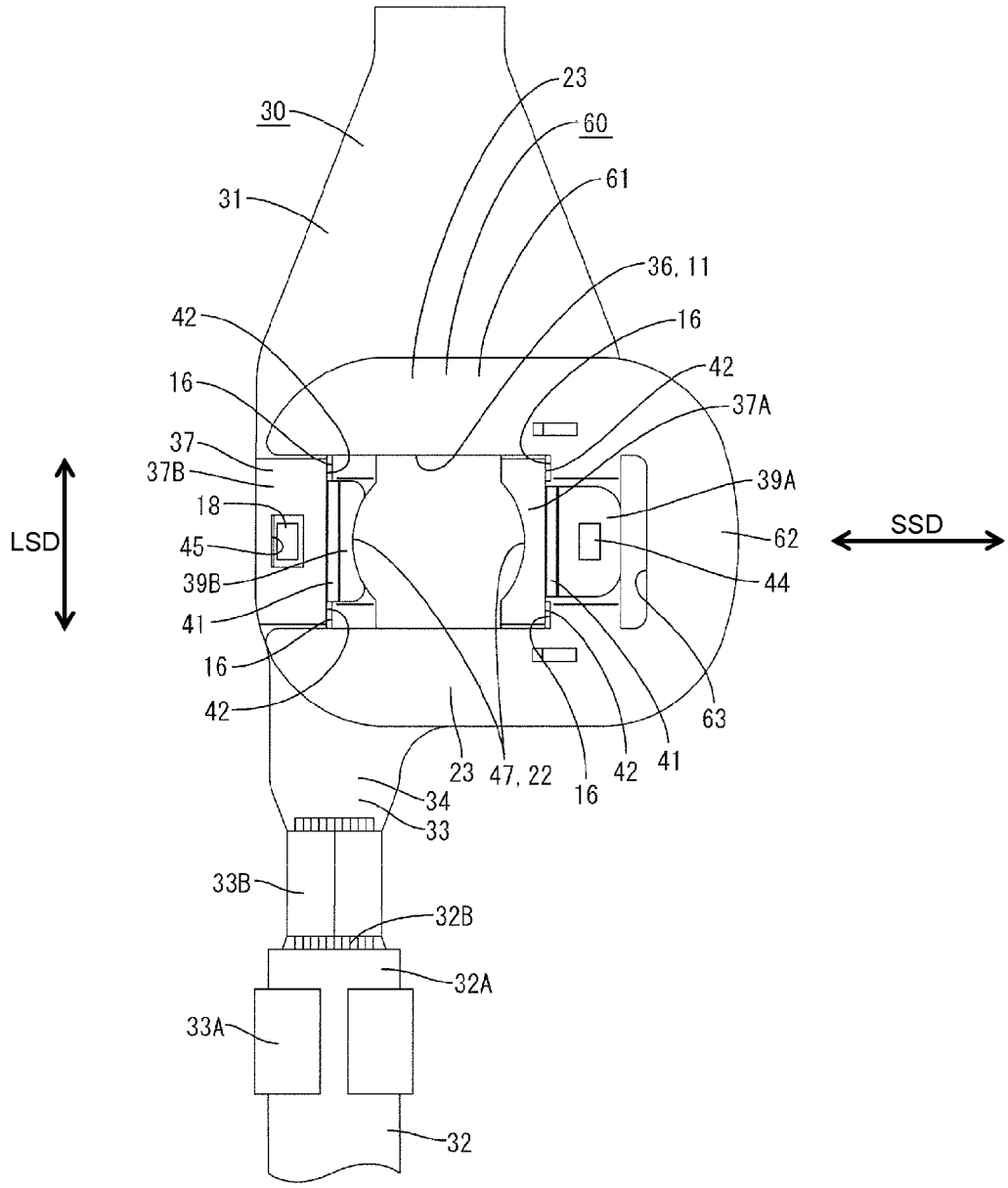
FIG. 9 is a plan view showing a terminal fitting in an assembled state with the auxiliary fitting.

An auxiliary fitting 60 according to a second embodiment is described with reference to FIGS. 8 and 9. The auxiliary fitting 60 of this embodiment differs from the first embodiment in including a projection 62 projecting out from a main body 61 that is formed with auxiliary inserting portions 12 and auxiliary placing portions 23. Note that constructions similar to or the same as those of the first embodiment are identified by the same reference numerals and are not described again.

The auxiliary fitting 60 of this embodiment is used with the laminate terminal fitting 30 without assembling it with another terminal fitting as in the first embodiment. More particularly, the auxiliary fitting 60 has an auxiliary insertion hole 11 for receiving the bolt B. The auxiliary inserting portions 12 and the auxiliary placing portions 23 are at the periphery of the auxiliary insertion hole 11. The auxiliary inserting portions 12 are inserted into the recesses 38 below the interlocking portions 37. The auxiliary placing portions 23 are arranged on the upper sides of the placing portions 48 at the periphery of the insertion hole 36 and near the interlocking portions 37.

The auxiliary fitting 60 long in the assembling direction and the projection 62 projects out from the rear side of the main body 61 in an assembling direction. The projection 62 has the same width as the main body 61 and the entire rear edge thereof is arcuate. A narrow slit 63 penetrates the auxiliary fitting 60 between a rear inserting portion 12B and the projection 62 and extends over substantially the entire width of the rear inserting portion 12B. A projecting distance of the projection 62 is substantially equal to a dimension of the rear inserting portion 12B in the assembling direction.

Substantially the entire projection 62 projects out from the assembling portion 31 when the auxiliary fitting 60 is assembled with the terminal fitting 30. At this time, the outer edge of the assembling portion 31 of the terminal fitting 30 extends substantially along a longer edge of the slit 63 closer to the rear inserting portion 12B.

As described above, the auxiliary fitting 60 includes the main body 61 formed with the auxiliary inserting portions 12 and the auxiliary placing portions 23 and the projection 62 projecting out from this main body 61. The projection 62 can be held when assembling the auxiliary fitting 60 with the terminal fitting 30. Thus, an assembling operation can be performed easily. Further, a probe for checking an electrical connection can be brought into contact with the projection 62.

Figure 10:
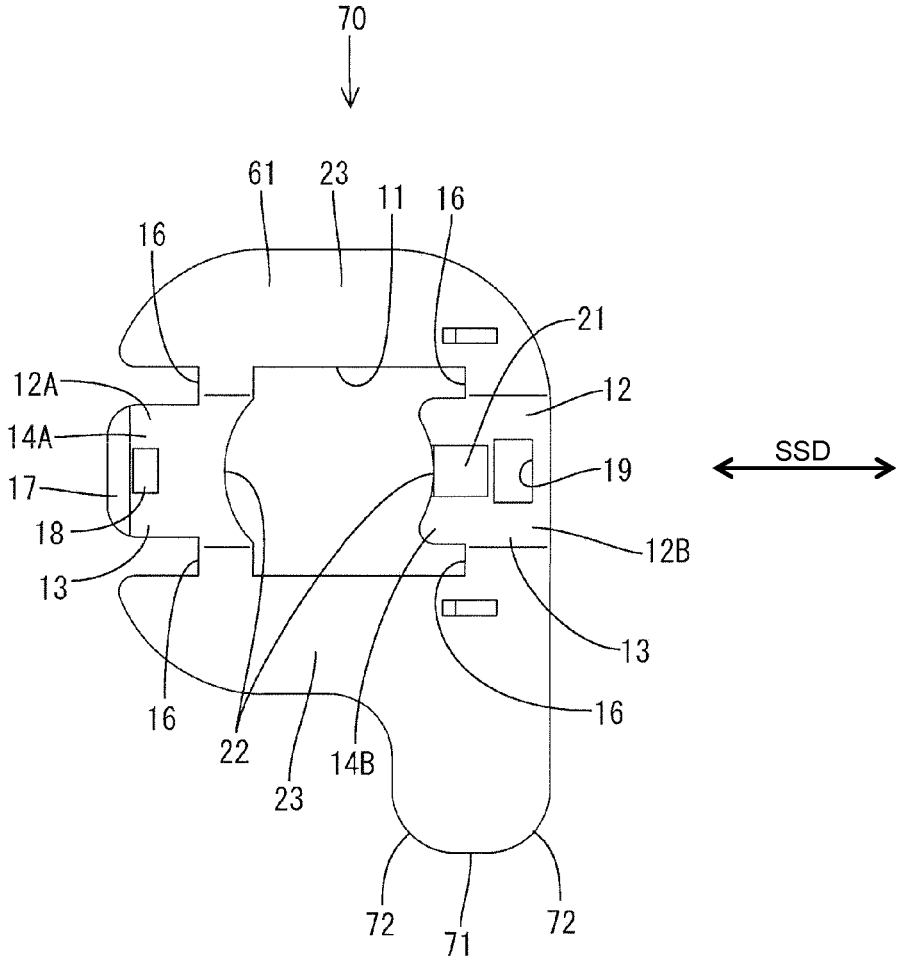
FIG. 10 is a plan view of an auxiliary fitting according to a third embodiment.
Figure 11:
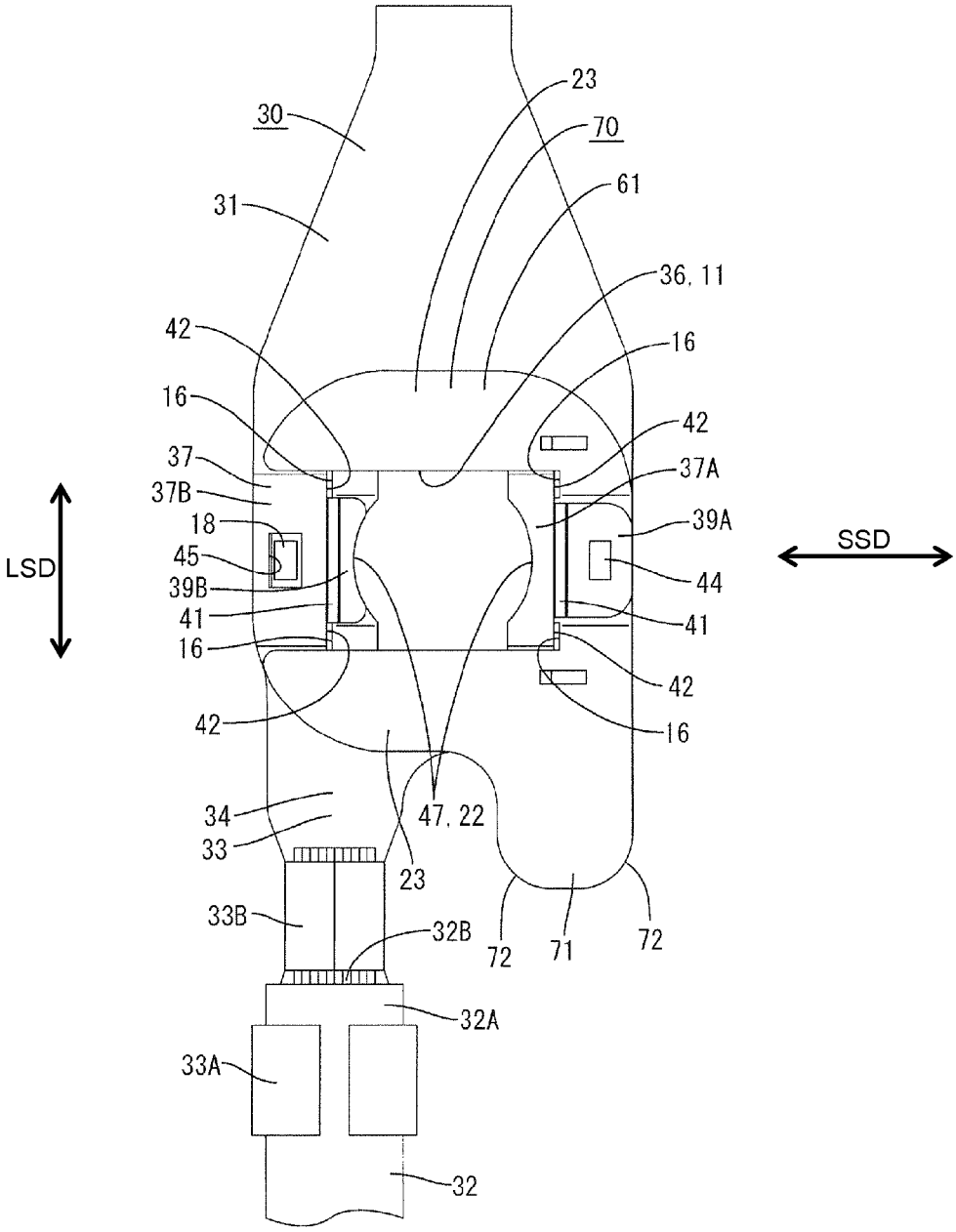
FIG. 11 is a plan view showing a terminal fitting in an assembled state with the auxiliary fitting.

An auxiliary fitting 70 according to a third embodiment of the invention is described with reference to FIGS. 10 and 11. The auxiliary fitting 70 differs from the first and second embodiments in that at least one projection 71 is provided on a side of a main body 61 lateral to an assembling direction. Note that constructions similar to or the same as the first and second embodiments are identified by the same reference numerals, but are not described again.

The auxiliary fitting 70 is used with the laminate terminal fitting 30 without assembling it with another terminal fitting as in the second embodiment, and includes an auxiliary insertion hole 11 for receiving the bolt B and the auxiliary inserting portions 12 and the auxiliary placing portions 23 at a periphery of the auxiliary insertion hole 11. The auxiliary inserting portions 12 are to be inserted into the recesses 38 below the interlocking portions 37. The auxiliary placing portions 23 are to be arranged on the upper sides of the placing portions 48 at the periphery of the insertion hole 36 and near the interlocking portions 37.

This auxiliary fitting 70 is formed with the auxiliary inserting portions 12 and the auxiliary placing portions 23 as in the second embodiment, but also has the projection 71, which is at the side of the main body 61 lateral to the assembling direction and lateral to a rear inserting portion 12B. The projection 71 projects substantially in an extending direction of the rear end edge of the main body 61 in the assembling direction. Rounded corners 72 are formed at the projecting end of the projecting portion 71.

Substantially the entire projecting portion 71 projects out from the assembling portion 31 when the auxiliary fitting 70 is assembled with the terminal fitting 30, as in the second embodiment. At this time, the projection 71 faces the wire connecting portion 33 of the terminal fitting 30 in the assembling direction and the projecting end edge of the projection 71 is slightly before (below in FIG. 11) an end edge of the wire barrel 33B closer to the main body 61.

As described above, the auxiliary fitting 70 includes the main body 61 formed with the auxiliary inserting portions 12, the auxiliary placing portions 23 and the projection 71 projecting out from the main body 61. The projection 71 can be held when assembling the auxiliary fitting 70 with the terminal fitting 30, as in the second embodiment. Thus, an assembling operation can be performed easily. Further, a probe for checking an electrical connection can be brought into contact with the projection 71.

The invention is not limited to the above described embodiments. For example, the following embodiments also are included in the scope of the invention.

The bolt B is inserted through the insertion hole 36 of the terminal fitting 30 and fastened to the body in the above embodiments. However, a bolt may project from the body, inserted through a terminal fitting and fastened with a nut. The terminal fitting 30 may be fixed to any other device, such as a casing, a battery, or the like.

Only one terminal fitting 30 assembled with the auxiliary fitting 10, 60 or 70 is fixed to the body in the above embodiments. However, the invention can be applied also in the case where a terminal fitting assembled with an auxiliary fitting is placed on the upper side of an assembly of a pair of terminal fittings and fixed to a body or three or more (an odd number of) terminal fittings and an auxiliary fitting are fixed at one position.

Although the auxiliary fitting 10, 60 or 70 is assembled with the terminal fitting 30 for grounding in the above embodiments, the present invention is not limited to this and can also be applied to a terminal fitting used for a purpose other than grounding.

The auxiliary fitting 10, 60 or 70 includes both the auxiliary inserting portions 12 and the auxiliary placing portions 23 at the periphery of the auxiliary insertion hole 11 in the above embodiments. However, either the auxiliary inserting portions 12 or the auxiliary placing portions 23 may be provided. For example, the auxiliary fitting may be a frame-shaped or U-shaped metal plate for surrounding the interlocking portions 37 of the terminal fitting 30 and include only auxiliary placing portions.

The auxiliary fitting 10, 60 or 70 is assembled with the terminal fitting 30 in the above embodiments. However, the auxiliary fitting may be integral with the body. For example, the auxiliary inserting portions may project from a surface of the body on which the terminal fitting is to be mounted and may be inserted into the recesses 38 of the interlocking portions 37 to be arranged below the interlocking portions 37.

The thickness of the auxiliary inserting portions 12 equals the depth of the recesses 38 of the terminal fitting 30 in the above embodiments. However, the thickness of the auxiliary inserting portions 12 may exceed the depth of the recesses 38 of the terminal fitting 30.

The upper surfaces of the auxiliary placing portions 23 and those of the interlocking portions 37 of the terminal fitting 30 are at the same height in the above embodiments. However, the upper surfaces of the auxiliary placing portions may be above those of the interlocking portions 37.

What is claimed is:

1. An auxiliary fitting for use with a laminate terminal fitting, the laminate terminal fitting having opposite upper and lower surfaces spaced apart by a selected thickness and including a wire connecting portion configured for connection to a wire and an assembling portion extending from the wire connecting portion, the assembling portion having placing panels and an insertion hole between the placing panels for receiving a fastening device, interlocking portions at a periphery of the insertion hole and being shifted up relative to the placing panels of the laminate terminal fitting by a distance equal to the selected thickness to define at least one recess that is engageable with interlocking portions of another laminate terminal fitting, the auxiliary fitting being engageable with the laminate terminal fitting when the laminate terminal fitting is not engaged with another laminate terminal fitting, the auxiliary fitting having opposite upper and lower surfaces spaced apart by a thickness equal to the selected thickness of the laminate terminal fitting and comprising:

auxiliary inserting portions configured to be inserted into the recess of the laminate terminal fitting so that the upper surface of the auxiliary fitting at the auxiliary inserting portions is in contact with the lower surface of the laminate terminal fitting at the interlocking portions and so that the lower surfaces of auxiliary fitting at the auxiliary inserting portions are coplanar with lower surfaces of the laminate terminal fitting at the placing panels; and auxiliary placing portions shifted up from the auxiliary inserting portions by the selected thickness of the laminate terminal fitting and arranged on the upper surface of the laminate terminal fitting at the placing panels at the periphery of the insertion hole so that the upper surface of the auxiliary fitting at the auxiliary placing portions is coplanar with the upper surface of the laminate terminal fitting at the interlocking portions, the auxiliary fitting having no wire connecting portion.

2. The auxiliary fitting of claim 1, further comprising at least one auxiliary insertion hole in the auxiliary fitting through which the fastening device is insertable.

3. The auxiliary fitting of claim 2, wherein at least one of the auxiliary inserting portions and the auxiliary placing portions is provided at a periphery of the auxiliary insertion hole.

4. The auxiliary fitting of claim 1, further comprising a main body formed with at least one of the auxiliary inserting portions and the auxiliary placing portions.

5. The auxiliary fitting of claim 4, further comprising a projection projecting out from the main body.

6. A fitting assembly comprising:

a laminate terminal fitting having opposite upper and lower surfaces spaced apart by a selected thickness and including a wire connecting portion configured for connection with a wire and an assembling portion unitary with the wire connection portion, an insertion hole formed in the assembling portion for receiving a fastening device, two placing panels disposed at opposed positions on a periphery of the insertion hole with the upper surface of the laminate terminal at the placing panels being in a single plane, two interlocking portions at opposed positions on the periphery of the insertion hole and being shifted relative to the plane of the placing panels by a distance equal to the selected thickness to define recesses between the placing panels and adjacent the respective interlocking portion; and an auxiliary fitting having opposite upper and lower surfaces spaced apart by a thickness equal to the selected thickness of the laminate terminal fitting and including an auxiliary insertion hole, two auxiliary placing panels disposed in opposed positions on a periphery of the auxiliary insertion hole, two auxiliary inserting portions at opposed positions on the periphery of the auxiliary insertion hole and being shifted relative to the auxiliary placing panels by a distance equal to the selected thickness of the laminate terminal fitting to define auxiliary recesses between the auxiliary placing panels and adjacent the respective auxiliary inserting portion, the auxiliary fitting having no wire connecting portion, the auxiliary inserting portions being in the respective recesses between the placing panels and adjacent the respective interlocking portions so that the upper surface of auxiliary fitting at the auxiliary inserting portions and the upper surface of the laminate terminal fitting at the placing panels lie in a first common plane and the upper surface of the auxiliary fitting at the auxiliary placing panels and the upper surface of the laminate terminal fitting at the interlocking portions lie in a second common plane for supporting the terminal fitting as the fastening device is tightened into the insertion hole and the auxiliary insertion hole, the first common plane and the second common plane being parallel to one another.

7. The fitting assembly of claim 6, wherein the laminate terminal fitting is a first laminate terminal fitting, the fitting assembly further comprising a second laminate terminal fitting, the first laminate terminal fitting being selectively engageable with either of the second laminate terminal fitting or the auxiliary fitting.

* * * * *